US010106391B2

(12) United States Patent
Schmitt

(10) Patent No.: US 10,106,391 B2
(45) Date of Patent: Oct. 23, 2018

(54) LIDDED FUNNEL DEVICE

(71) Applicant: Joel Schmitt, Aberdeen, SD (US)

(72) Inventor: Joel Schmitt, Aberdeen, SD (US)

( * ) Notice: Subject to any disclaimer, the term of this patent is extended or adjusted under 35 U.S.C. 154(b) by 38 days.

(21) Appl. No.: 15/288,202

(22) Filed: Oct. 7, 2016

(65) Prior Publication Data

US 2018/0099849 A1 Apr. 12, 2018

(51) Int. Cl.

*B67C 11/04* (2006.01)
*B67C 11/02* (2006.01)
*B67C 11/00* (2006.01)

(52) U.S. Cl.

CPC ..... *B67C 11/04* (2013.01); *B67C 11/02* (2013.01); *B67C 2011/20* (2013.01)

(58) Field of Classification Search

CPC ..... B67C 11/00; B67C 11/04; B67C 2011/20
USPC ..... 141/331–345
See application file for complete search history.

(56) References Cited

U.S. PATENT DOCUMENTS 6,098,678 A * 8/2000 Shears ..... B67C 11/02 141/331
6,318,422 B2 11/2001 Woratyla
2003/0106608 A1* 6/2003 Walter ..... B67C 11/02 141/331
2003/0106609 A1* 6/2003 Leoncavallo ..... B65B 39/00 141/340
2005/0263210 A1* 12/2005 Najafi ..... B01D 29/085 141/331
2009/0151815 A1* 6/2009 Peng ..... B67C 11/02 141/337

FOREIGN PATENT DOCUMENTS

| | | |
|---|---|---|
| CN | 2209672 | 10/1995 |
| CN | 2832780 | 11/2006 |
| CN | 201280423 | 7/2009 |
| CN | 202148178 | 2/2012 |
| CN | 202390187 | 8/2012 |
| CN | 204079454 | 1/2015 |
| CN | 204400595 | 6/2015 |
| GB | 18302 | 12/1896 |
| JP | 2005138910 | 6/2005 |

* cited by examiner

*Primary Examiner* — Craig Schneider
*Assistant Examiner* — Timothy P Kelly

(57) ABSTRACT

A lidded funnel device provides a funnel having an enclosable interior space. The device includes a funnel having a stem section extending from a mouth section. An upper edge of the mouth section defines a broad opening into the funnel. The stem section has a polygonal exterior surface. An end cap is engageable to the stem section to cover and seal an open end of the stem section. Each of a plurality of pins is coupled to the mouth section. Each of a plurality of clips extends from a lid. The clips are removably engageable to the pins wherein the lid is pivotally coupled to the funnel. The lid is shaped complementary to the upper edge of the mouth section to cover the broad opening into the funnel when the lid is in a closed position.

9 Claims, 5 Drawing Sheets

LIDDED FUNNEL DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to funnel devices and more particularly pertains to a new funnel device for providing a funnel having an enclosable interior space.

BRIEF SUMMARY OF THE INVENTION

An embodiment of the disclosure meets the needs presented above by generally comprising a funnel having a stem section extending from a mouth section. An upper edge of the mouth section defines a broad opening into the funnel. The stem section has a polygonal exterior surface. An end cap is engageable to the stem section to cover and seal an open end of the stem section. Each of a plurality of pins is coupled to the mouth section. Each of a plurality of clips extends from a lid. The clips are removably engageable to the pins wherein the lid is pivotally coupled to the funnel. The lid is shaped complementary to the upper edge of the mouth section to cover the broad opening into the funnel when the lid is in a closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
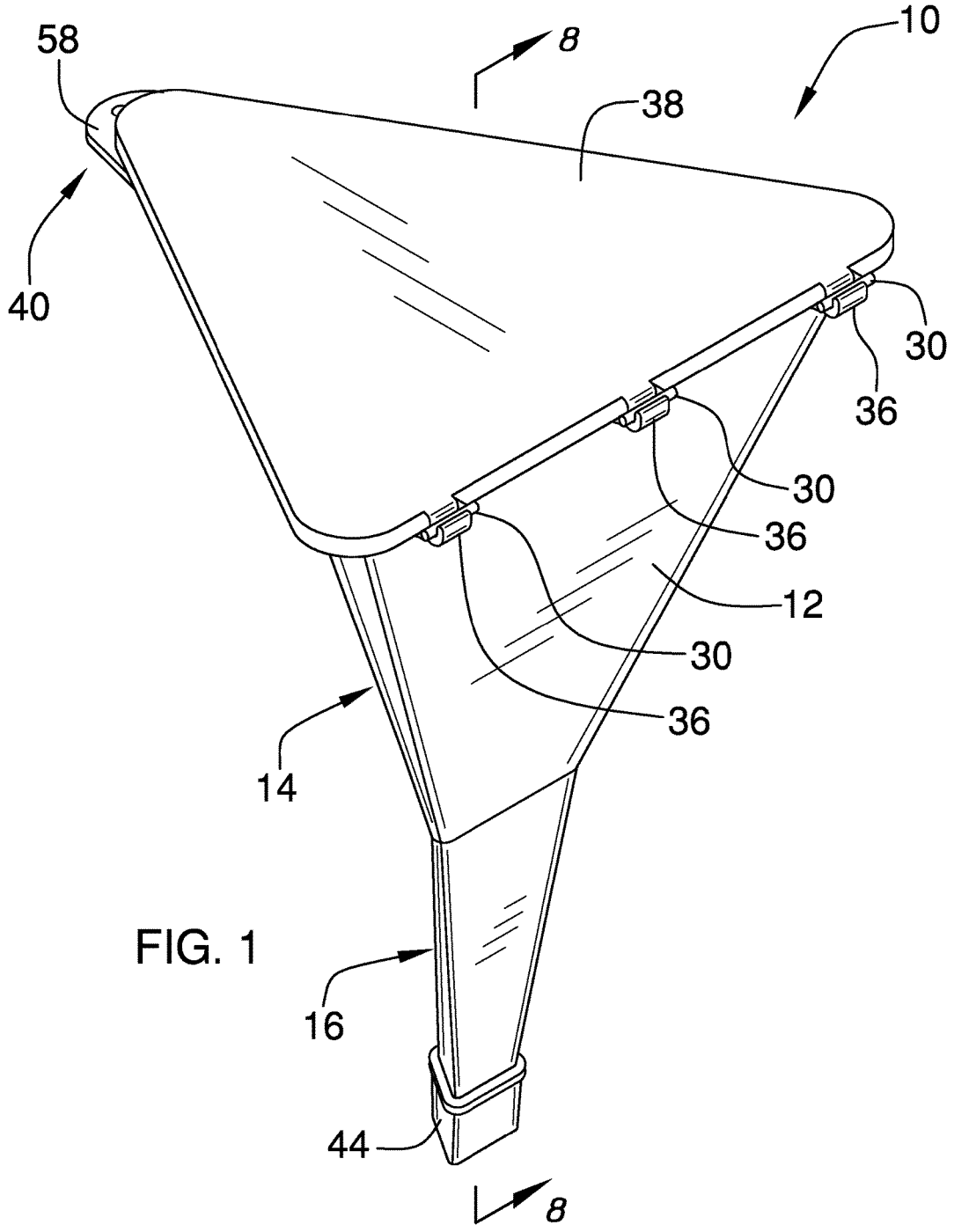
FIG. 1 is a top front side perspective view of a lidded funnel device according to an embodiment of the disclosure.
Figure 2:
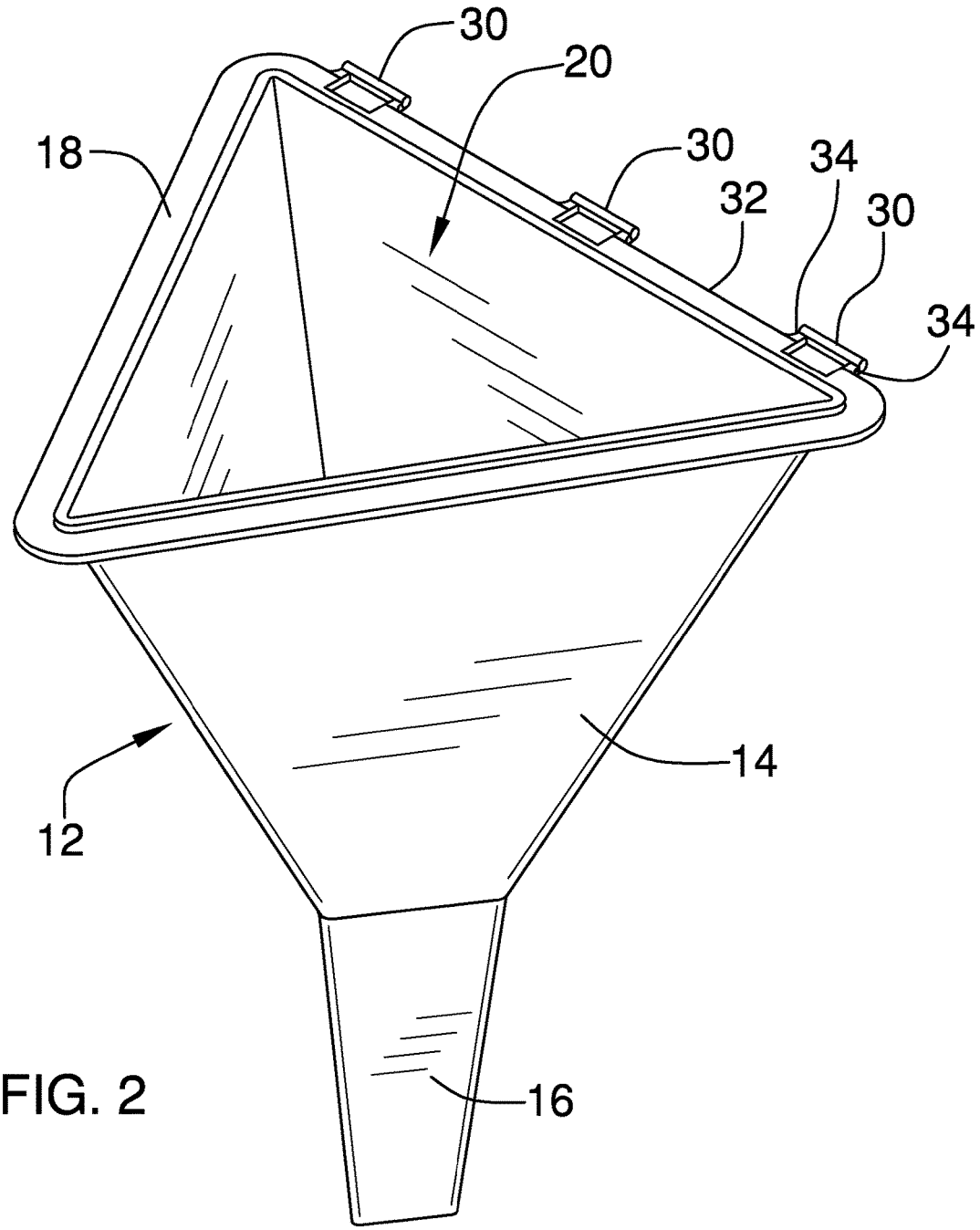
FIG. 2 is a top front side perspective view of an embodiment of the disclosure.
Figure 3:
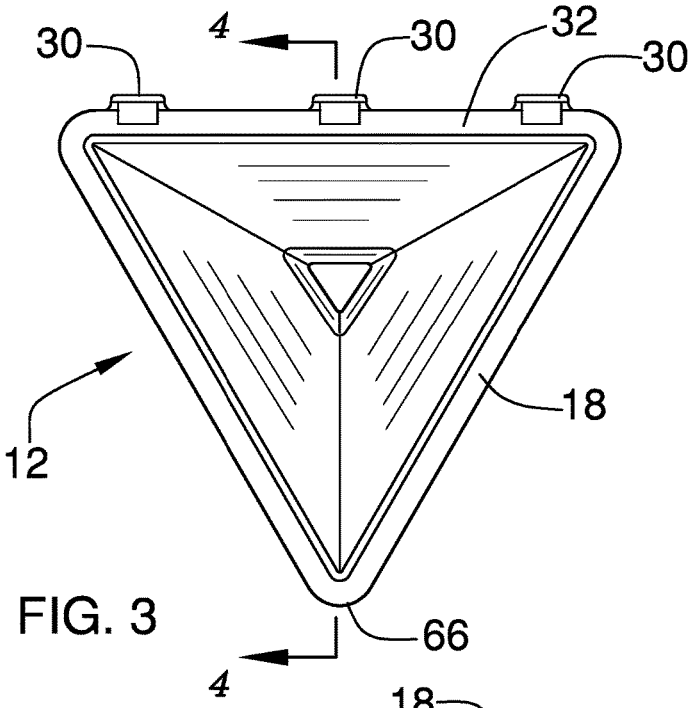
FIG. 3 is a top view of an embodiment of the disclosure.
Figure 4:
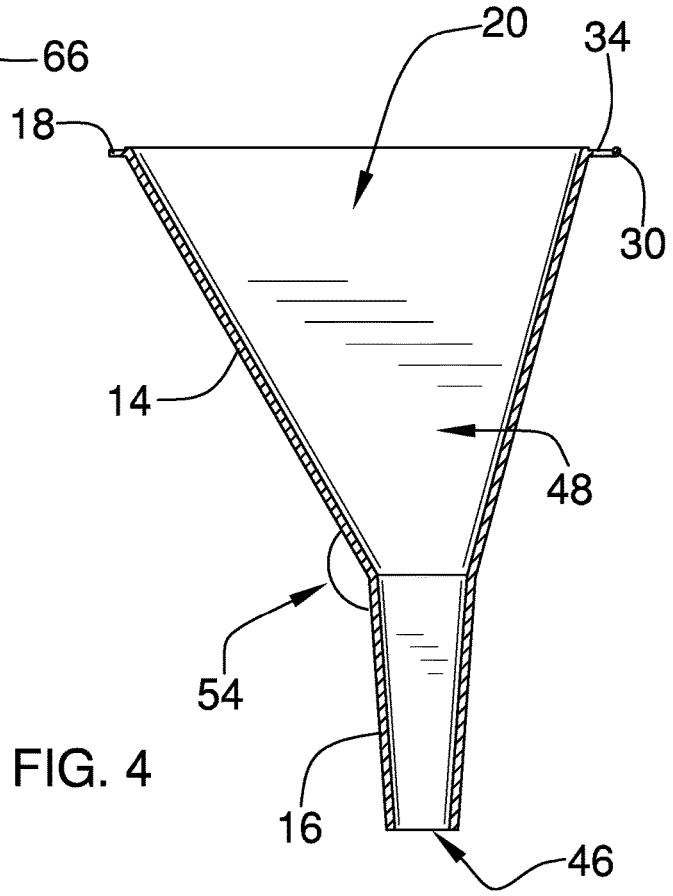
FIG. 4 is a cross-sectional view of an embodiment of the disclosure taken along line 4-4 of FIG. 3.
Figure 5:
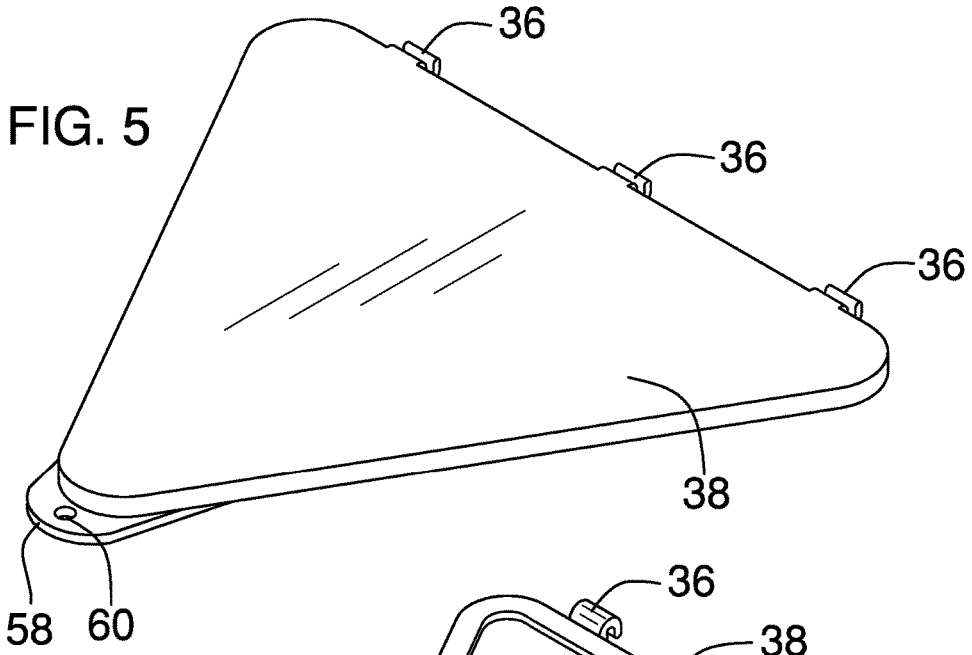
FIG. 5 is a top front side perspective view of a lid an embodiment of the disclosure.
Figure 6:
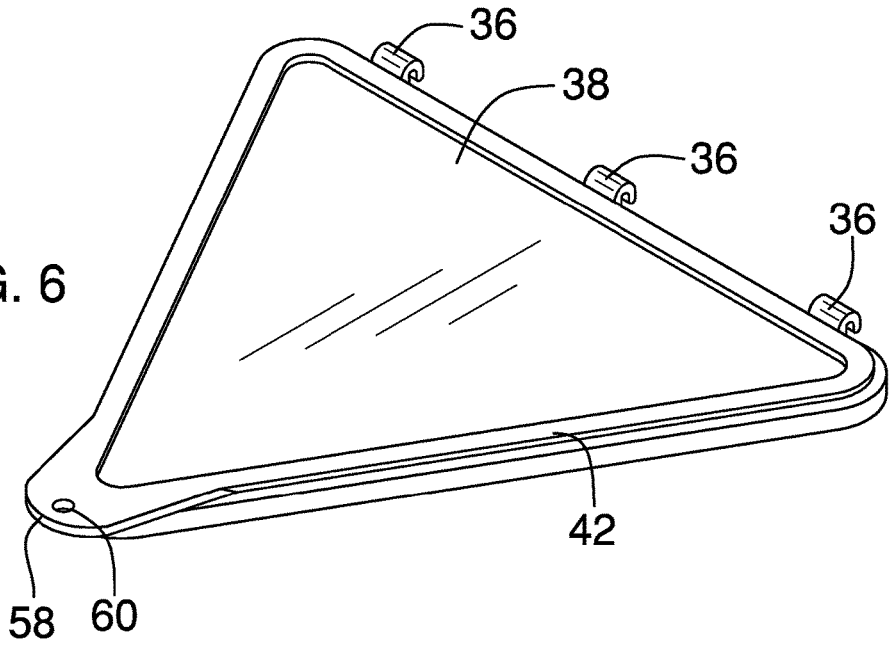
FIG. 6 is a bottom rear side perspective view of a lid of an embodiment of the disclosure.
Figure 7:
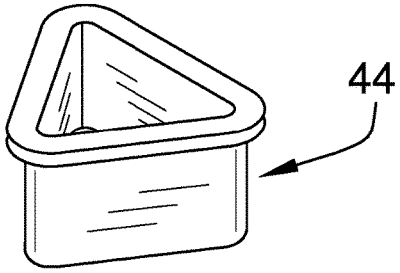
FIG. 7 is a top front side perspective view of an end cap of an embodiment of the disclosure.
Figure 8:
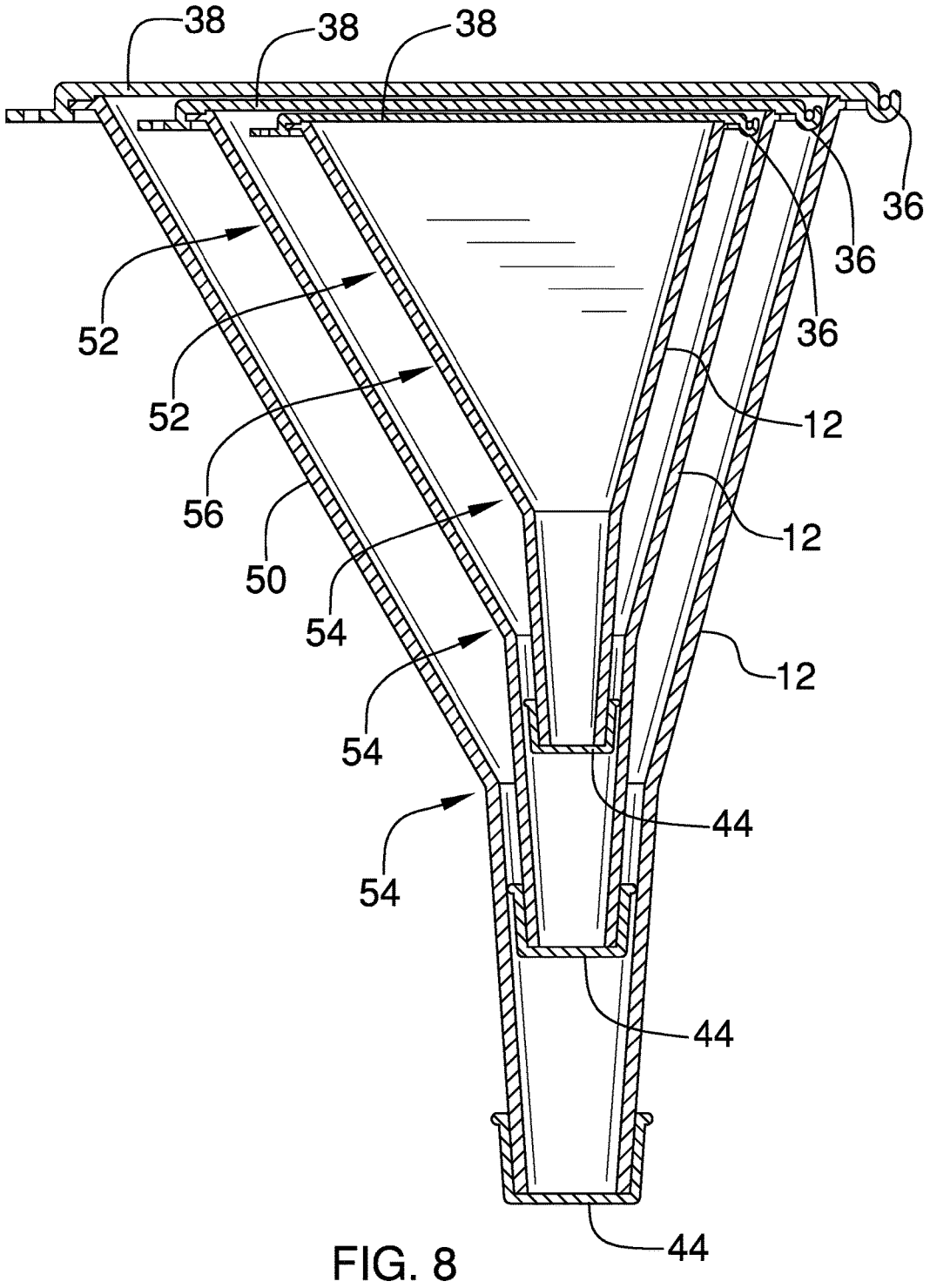
FIG. 8 is a cross-sectional view similar to FIG. 4 showing a nested embodiment of the disclosure.

With reference now to the drawings, and in particular to FIGS. 1 through 8 thereof, a new funnel device embodying the principles and concepts of an embodiment of the disclosure and generally designated by the reference numeral 10 will be described.

As best illustrated in FIGS. 1 through 8, the lidded funnel device 10 generally comprises a funnel 12 having a mouth section 14 and a stem section 16. The stem section 16 extends from the mouth section 14. An upper edge 18 of the mouth section 14 defines a broad opening 20 into the funnel 12. The broad opening 20 is substantially triangular and has rounded corners. The mouth section 14 and stem section 16 are integral to each other and defined by a relatively thin wall having a substantially constant thickness. The mouth section 14 tapers extending away from the broad opening 20 wherein the mouth section 14 is a truncated pyramidal shape. The stem section 16 has a polygonal exterior surface 22 wherein the stem section 16 is configured to form gaps between the exterior surface 22 and a rim of a container when the stem section 16 is inserted into the container. Thus, the stem section 16 is prevented from forming a seal with the rim to prevent air from the container passing up through the stem section 16 while the funnel 12 is in use. The polygonal exterior surface 22 of the stem section 16 is triangular.

Each of a plurality of pins 30 is coupled to the mouth section 14. The pins 30 are linearly aligned with each other. Each of the pins 30 is offset and parallel to a straight side 32 of the broad opening 20 into the funnel 12. Each pin 30 is coupled to the mouth section 14 by arms 34 which space the pins 30 from the upper edge 18 of the mouth section 14.

Each of a plurality of clips 36 extends from a lid 38. The clips 36 are removably engageable to the pins 30 wherein the lid 38 is pivotally coupled to the funnel 12. The lid is shaped complementary to the upper edge 18 of the mouth section 14 wherein the lid 38 covers the broad opening 20 into the funnel 12 when the lid 38 is in a closed position 40. The lid 38 is substantially planar and includes a peripheral lip 42.

The peripheral lip 42 engages the upper edge 18 of the mouth section 14 such that the lid 38 is substantially sealed onto the mouth section 14. A tab 58 is coupled to and extends from the lid 38. The tab 58 is positioned to extend from a corner 66 of the lid 38 opposite the straight side 32 when the lid 38 is coupled to the funnel 12. The tab 58 may be structured to include a hole 60 extending therethrough.

An end cap 44 is engageable to cover and seal an open end 46 of the stem section 16 of the funnel 12. Thus, the end cap 44 and lid 38 enclose an interior space 48 of the funnel 12 allowing the funnel 12 to be used and then the interior space 48 enclosed for temporary storage and/or transport prior to the funnel 12 being cleaned.

The funnel 12 is one of a plurality of funnels 12 and the lid 38 is one of a plurality of lids 38. Each lid 38 being couplable to an associated one of the plurality of funnels 12. Each of the plurality of funnels 12 decreases in size wherein the plurality of funnels 12 includes a largest funnel 50 and a plurality of smaller funnels 52. The smaller funnels 52 are positionable to nest inside each other and the largest funnel 50. An exterior angle 54 between the mouth section 14 and the stem section 16 increases from a smallest funnel 56 of the funnels 12 to the largest funnel 50. This facilitates removal of the funnels 12 from each other when nested.

In use, the funnels 12 may be provided as a set. The desired size is selected and the lid 38 of the selected funnel 12 is pivoted or removed to provide access to the broad opening 20 of the selected funnel 12. The end cap 44 is removed to allow use of the selected funnel 12 in a conventional manner. After use, the interior space 48 of the selected funnel 12 is enclosed by reattaching and closing of the lid 38 and re-engagement of the end cap 44. The selected funnel 12 may then be nested with the other funnels 12 for repeated use or cleaning at later time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lidded funnel device comprising:

a funnel having a mouth section and a stem section, said stem section extending from said mouth section, an upper edge of said mouth section defining a broad opening into said funnel, said stem section having a polygonal exterior surface, said polygonal exterior surface extending fully between said mouth section and an open end of said stem section;

an end cap, said end cap being engageable to said stem section such that said end cap covers and seals said open end of said stem section;

a plurality of pins coupled to said mouth section;

a lid; and a plurality of clips extending from said lid, said clips being removably engageable to said pins wherein said lid is pivotally coupled to said funnel, said lid being shaped complementary to said upper edge of said mouth section wherein said lid covers said broad opening into said funnel when said lid is in a closed position.

2. The device of claim 1, further comprising said pins being linearly aligned.

3. The device of claim 1, further comprising said broad opening being triangular.

4. The device of claim 3, further comprising each of said pins being offset and parallel to a straight side of said broad opening into said funnel.

5. A lidded funnel set device comprising:

a funnel having a mouth section and a stem section, said stem section extending from said mouth section, an upper edge of said mouth section defining a broad opening into said funnel, said stem section having a polygonal exterior surface, said polygonal exterior surface extending fully between said mouth section and an open end of said stem section;

an end cap, said end cap being engageable to said stem section such that said end cap covers and seals said open end of said stem section;

a plurality of pins coupled to said mouth section;

a lid;

a plurality of clips extending from said lid, said clips being removably engageable to said pins wherein said lid is pivotally coupled to said funnel, said lid being shaped complementary to said upper edge of said mouth section wherein said lid covers said broad opening into said funnel when said lid is in a closed position; and said funnel being one of a plurality of funnels and said lid being one of a plurality of lids couplable to an associated one of said plurality of funnels, said plurality of funnels decreasing in size wherein said plurality of funnels includes a largest funnel and a plurality of smaller funnels, said smaller funnels nesting inside each other and said largest funnel.

6. The device of claim 3, further comprising said mouth section tapering extending away from said broad opening wherein said mouth section is a truncated pyramidal shape.

7. The device of claim 5, further comprising an exterior angle between said mouth section and said stem section increasing from a smallest one of said funnels to said largest funnel.

8. The device of claim 1, further comprising said polygonal exterior surface of said stem section being triangular.

9. A lidded funnel set device comprising:

a funnel having a mouth section and a stem section, said stem section extending from said mouth section, an upper edge of said mouth section defining a broad opening into said funnel, said broad opening being triangular, said mouth section tapering extending away from said broad opening wherein said mouth section is a truncated pyramidal shape, said stem section having a polygonal exterior surface, said polygonal exterior surface extending fully between said mouth section and an open end of said stem section, said polygonal exterior surface of said stem section being triangular;

an end cap, said end cap being engageable to said stem section such that said end cap covers and seals said open end of said stem section;

a plurality of pins coupled to said mouth section, said pins being linearly aligned, each of said pins being offset and parallel to a straight side of said broad opening into said funnel;

a lid;

a plurality of clips extending from said lid, said clips being removably engageable to said pins wherein said lid is pivotally coupled to said funnel, said lid being shaped complementary to said upper edge of said mouth section wherein said lid covers said broad opening into said funnel when said lid is in a closed position; and said funnel being one of a plurality of funnels and said lid being one of a plurality of lids couplable to an associated one of said plurality of funnels, said plurality of funnels decreasing in size wherein said plurality of funnels includes a largest funnel and a plurality of smaller funnels, said smaller funnels nesting inside each other and said largest funnel, an exterior angle between said mouth section and said stem section increasing from a smallest one of said funnels to said largest funnel.

* * * * *